US008413583B2

(12) United States Patent
Sloan et al.

(10) Patent No.: US 8,413,583 B2
(45) Date of Patent: Apr. 9, 2013

(54) HOLE COVERING AND LOCATOR

(76) Inventors: Samuel T. Sloan, Hempstead, TX (US); Patricia A. Sloan, Hempstead, TX (US)

( * ) Notice: Subject to any disclaimer, the term of this patent is extended or adjusted under 35 U.S.C. 154(b) by 322 days.

(21) Appl. No.: 12/842,907

(22) Filed: Jul. 23, 2010

(65) Prior Publication Data

US 2012/0017791 A1 Jan. 26, 2012

(51) Int. Cl.
*F42D 3/00* (2006.01)

(52) U.S. Cl.
USPC ..... 102/304; 166/75.13

(58) Field of Classification Search ..... 102/304, 102/319; 166/135, 75.13, 92.1, 94.1
See application file for complete search history.

(56) References Cited

U.S. PATENT DOCUMENTS

| | | | | |
|---|---|---|---|---|
| 2,811,839 | A | | 11/1957 | McReynolds, Jr. |
| 3,126,827 | A | | 3/1964 | McReynolds, Jr. |
| 3,362,478 | A | | 1/1968 | McReynolds, Jr. |
| 3,674,088 | A | * | 7/1972 | Ovelson ..... 166/192 |
| 5,509,477 | A | * | 4/1996 | Ryan ..... 166/76.1 |
| 5,622,208 | A | * | 4/1997 | Vinson ..... 138/89 |
| 5,979,117 | A | * | 11/1999 | Fuller ..... 52/19 |

FOREIGN PATENT DOCUMENTS

| | | | |
|---|---|---|---|
| CA | 550499 | A | 12/1957 |
| CA | 739772 | A | 8/1966 |

* cited by examiner

*Primary Examiner* — Daniel J Troy

(57) ABSTRACT

A covering that has a means for support, a means for abutment to a wall, and a means for retaining a sensing element. The covering includes a body portion and a perimeter portion with a plurality of radially extending fins. Fins with or without boss are useful for abutment to a wall or surface. One or more means for retaining positioned in the interior of the body, are useful for fixedly positioning or holding a sensing element. The covering may be position on or into a hole and optionally includes additional elements for function and use, such as reinforcing members on the radially extending fins, a central hub, and a spool position around the hub.

17 Claims, 10 Drawing Sheets

HOLE COVERING AND LOCATOR

CROSS-REFERENCE TO RELATED APPLICATION

Not applicable

BACKGROUND

The application relates generally to a covering of or plug for a bore hole, such as a hole in the earth used in connection with seismic exploration and for locating said covering after placement in the hole.

Coverings for holes serve several purposes. When used with explosives, holes are drilled and filled with a charge that will explode. Coverings for such holes will, among other things, retard the release of blast gas from the hole, which if released without restriction, reduces the effectiveness of the explosive and can also create an overpressure status or air concussion in addition to injury and/or property damage. Coverings may also allow a hole to be readily located at a later time. Current hole coverings are difficult to find and/or difficult to use, as they are required to coordinate with a number of independent parts, such as those required for location of the hole and blasting.

SUMMARY

The article disclosed herein relates to a covering that solves one or more problems observed in the prior art.

Generally, a covering described herein includes a perimeter portion and a conical portion. The perimeter includes a plurality of radially extending members. One, some or all of the radially extending members may include one or more boss and a reinforcing member. Typically, reinforcing members are positioned on a first planar surface of the radially extending member. The conical portion of the covering generally includes a central hub in its interior and more than one means for retaining positioned in the conical portion. Radially extending members may be unevenly sized and shaped. Radially extending members may include one or more boss positioned on a second planar surface. In some embodiments, only a portion of the radially extending members will include one or more boss and/or a reinforcing member. The covering may further comprise a sensing element fixedly positioned in the conical portion by a means for retaining. The sensing element may be a magnet. The covering may further comprise a spool in cooperation with and surrounding the hub, positioned in the conical portion of the covering. The spool is generally wrapped with electrical wiring that is cooperative with a detonating means. The covering may further comprise and be cooperative with a detonating means. The covering may further comprise and be cooperative with a electrically operating means. The covering may further comprise and be cooperative with a sensing means. With the covering, at least one radially extending member may include a thru hole.

In addition, further embodiments disclosed herein describe a covering comprising a means for support, a means for abutment to a wall and a means for retaining a sensing means. The means for support includes a perimeter portion and a conical portion, wherein the perimeter includes a plurality of radially extending members having at least two planar surfaces and one or more radially extending members have a reinforcing member; wherein the conical portion includes generally a central hub at its base. The means for abutment includes a plurality of radially extending members having at least two planar surfaces, wherein at least one of the planar surfaces one more than one of the radially extending members includes at least one boss. The means for retaining includes one or more of a tab or a retainer, each positioned in the interior surface of the covering and often near the base of the covering.

Those skilled in the art will further appreciate the above-noted features and advantages of the invention together with other important aspects thereof upon reading the detailed description that follows and in conjunction with the drawings.

BRIEF DESCRIPTION OF THE DRAWINGS

For more complete understanding of the features and advantages of the inventions described herein, reference is now made to a description of the invention along with accompanying figures, wherein.

DESCRIPTION

Figure 1:
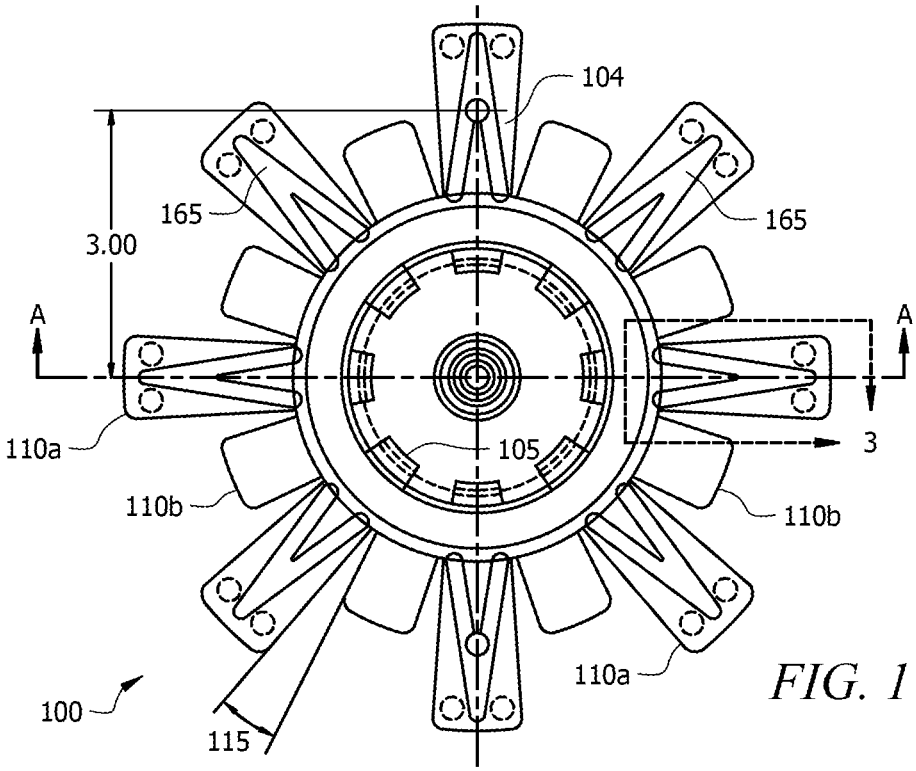
FIG. 1 depicts a top view of a representative embodiment of a covering described herein.

Although making and using various embodiments are discussed in detail below, it should be appreciated that the description provides many inventive concepts that may be embodied in a wide variety of contexts. Any specific embodiments discussed herein are merely illustrative of ways to make and use the invention, and do not limit the scope of the invention.

References will now be made to the drawings wherein like numerals refer to like or similar parts throughout. The drawing figures are not necessarily to scale and certain features may be shown exaggerated in scale or in somewhat generalized or schematic form in the interest of clarity and conciseness.

Figure 2:
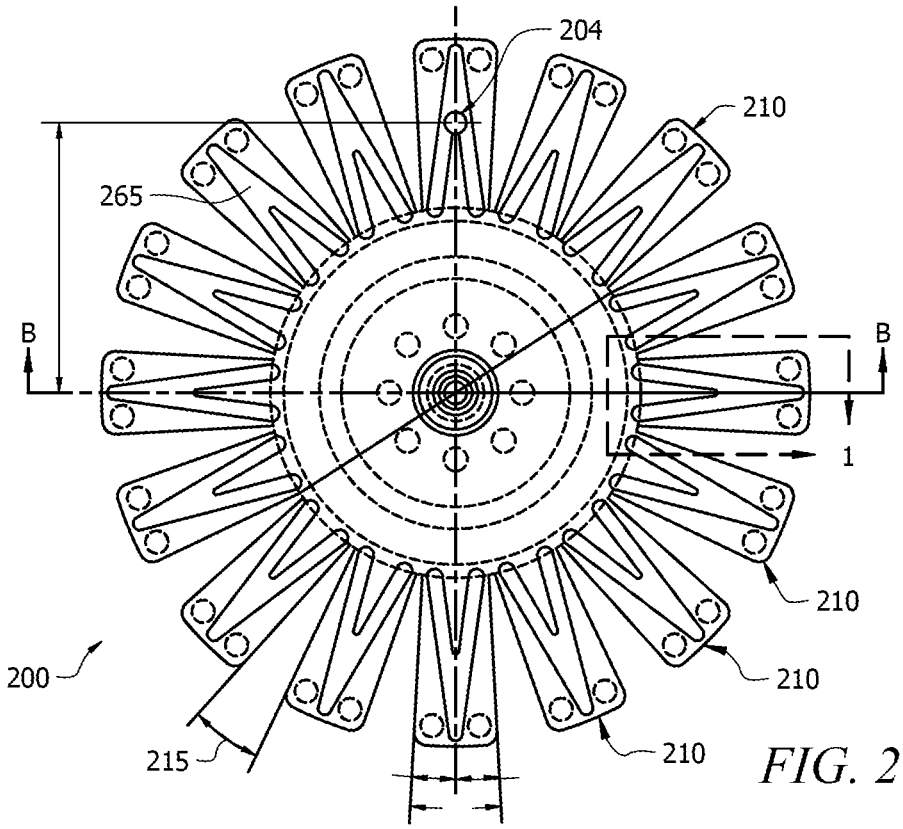
FIG. 2 depicts a top view of another representative embodiment of a covering described herein.

In one or more embodiments are covering for holes as depicted in FIGS. 1-6, 10, 13, 14, 15 and 16 as representative covering 100, 200, 300, 400, 500, 600, 1000, 1300, 1400, 1500 and 1600, respectively. FIG. 1 depicts a top view of representative covering 100 in an expansive position, which includes a plurality of fins 110. Fins extend radially outward and are not generally considered to be contiguous. The fins may be uniformly sized and shaped or may be sized and shaped to form a varying pattern. An example of non-uniform sized and shaped fins include fins 110*a* and 110*b* of FIG. 1. The fins of FIG. 1 have a 15 degree displacement angle between fins 110*a* and 110*b*, represented by line 115. Other variations are possible and may be desired and may be dependent on hole size, cost of operation and ease of manufacturing. An example of uniformly sized and shaped fins includes fins 210, as depicted in FIG. 2. The fins of FIG. 2 have a 15 degree displacement angle between fins, represented by line 215. Other values are possible and may be desired. Both FIG. 1 and FIG. 2 are representative coverings showing sixteen fins; however, other numbers are equally permissible, may be desirable, and may be influenced by hole size, cost of operation and ease of manufacturing. When desired, varying the size, shape and number of the fins may reduce the amount of covering material necessary. Some shapes and sizes may provide ease in placement of the covering when in use, such as a covering shown in FIG. 1 or FIG. 2.

Figure 6:
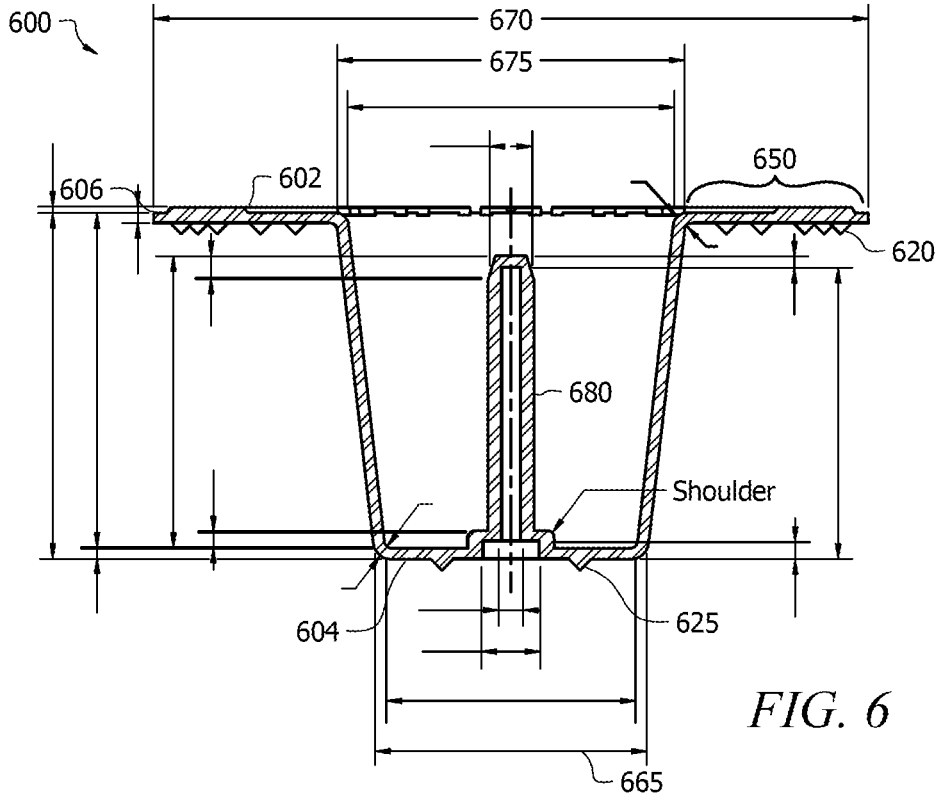
FIG. 6 depicts a representative cross sectional view of FIG. 2 taken at line B.

The plurality of fins optionally include one or more boss or protrusions on at least one surface. Generally, boss are located on a bottom surface of a fin and generally near its outermost end, such as that depicted in FIG. 3 as boss 320 or in FIG. 7A as boss 720. Boss may be provided in pairs or other patterns and on one, some or all of the fins. Boss may be shaped as depicted in FIG. 6 at 620 or FIG. 7 at 720 or may have an alternative shapes, as desired, in view of, for example, cost of operation and/or ease of manufacturing.

Figure 8:
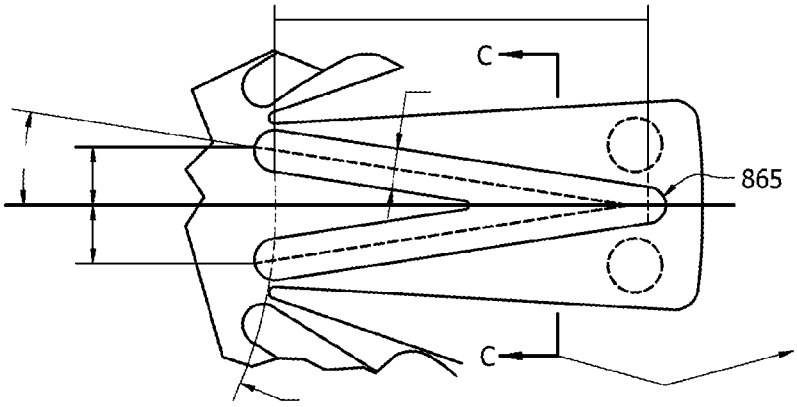
FIG. 8 depicts an enlarged view of a fin from boxed portion 1 of FIG. 2.
Figure 9:
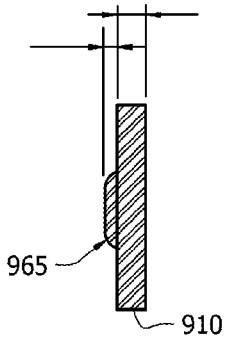
FIG. 9 depicts a representative cross-section view of FIG. 8 taken at line C.

FIG. 2 depicts a top view of another representative covering 200 in an expansive position including a plurality of fins 210. Fins, such as fins 110 of FIG. 1 and fins 210 of FIG. 2, may further include reinforcing member 165 or 265, respectively. An enlarged of a reinforcing member of FIG. 2 is depicted in FIG. 8 as member 865. One representative form of the reinforcing member, as depicted in the drawings, is v-shaped. Alternative shapes and dimensions may be used as desired. Said members offer weight and reinforcement to a fin. Some or all of the fins may include a reinforcing member. FIG. 9 shows in cross section from line C a side view of a fin 910 having a reinforcing member 965.

At least one fin may optionally include a thru hole. An example of a thru hole is depicted in FIG. 1 as 104 and in FIG. 2 and 204. Thru holes may be positioned on or near a reinforcing member. A representative dimension for a thru hole is one having a diameter of at or about 0.25 inches. As the covering expands in diameter, the thru hole may also be increased in size. Thru holes offer a location for wiring to be placed through or retained. Thru holes may offer additional purposes as needed and/or desired.

Figure 3:
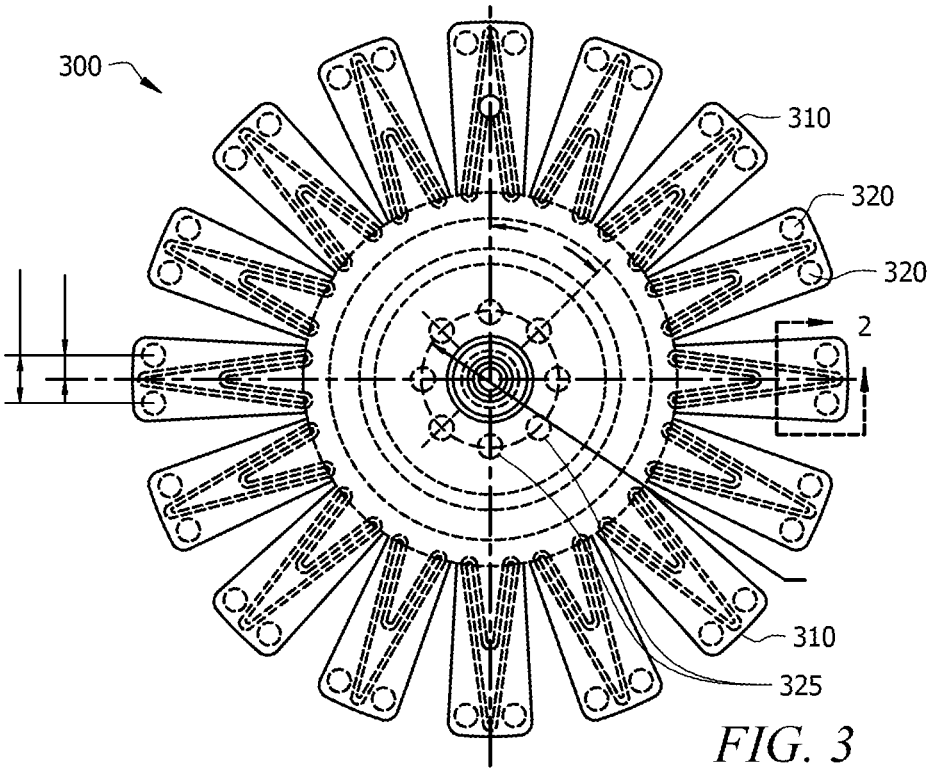
FIG. 3 depicts a representative bottom view of the covering of FIG. 2.
Figure 4:
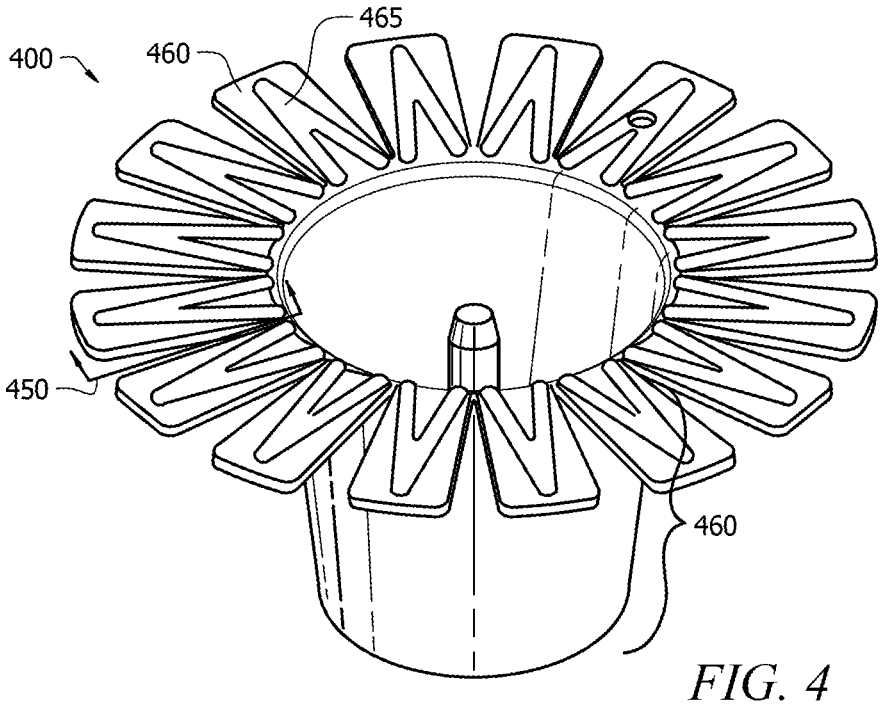
FIG. 4 depicts a representative top plan view of the embodiment of FIG. 2.
Figure 13:
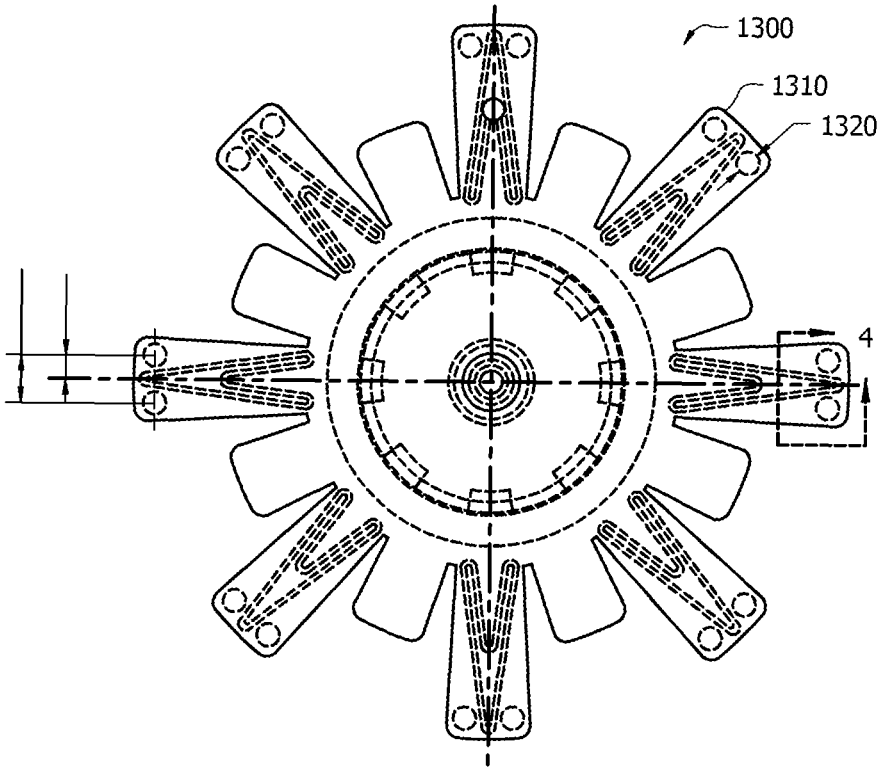
FIG. 13 depicts a representative bottom view of the covering of FIG. 1.
Figure 14A:
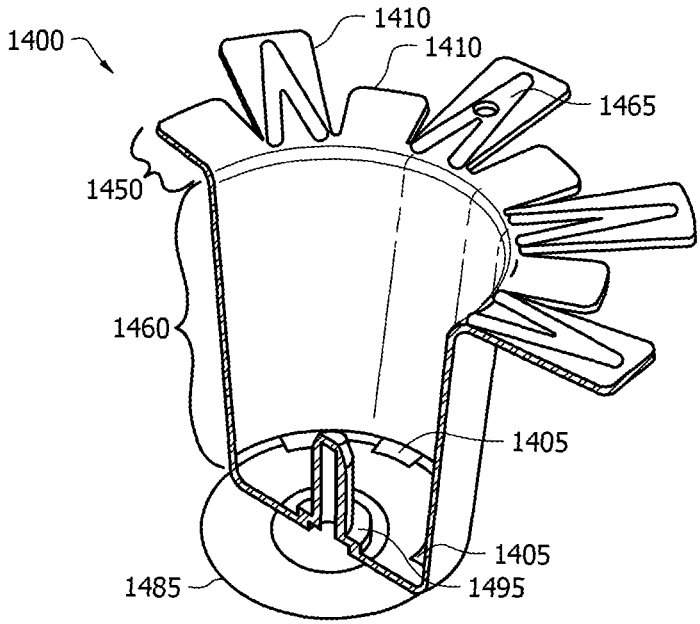
FIG. 14 depicts a representative top plan view of the embodiment of FIG. 1 shown in full (FIG. 14B) or in cross-section (FIG. 14A)
Figure 14B:
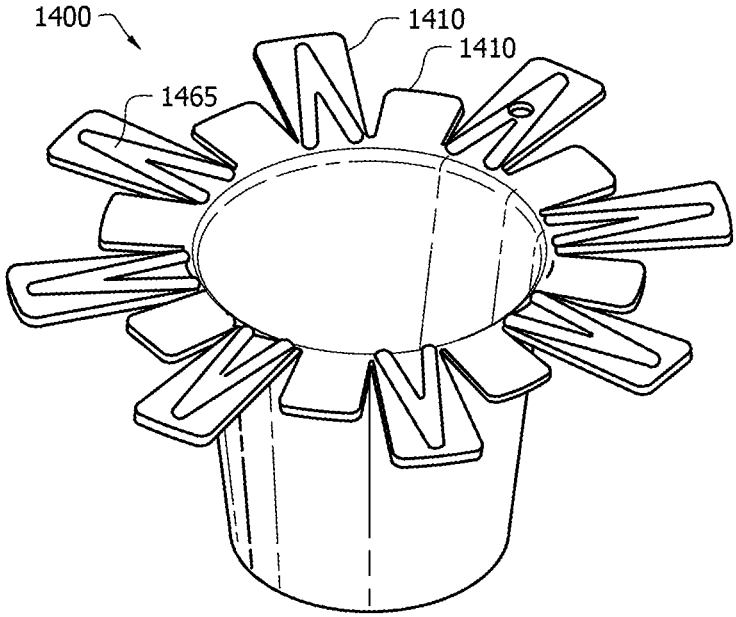

FIGS. 3 and 13 each depict a bottom view of representative coverings 300 and 1300. Both FIG. 3 and FIG. 13 illustrate a covering in an expansive position. Each of FIG. 3 and FIG. 13 also illustrate a plurality of fins 310 and 1310, respectively. Fins 310 and 1310 each include at least one boss 320 and 1320, respectively. Boss, when may have a cross-section diameter in one plane that is the same as a thru hole same general diameter FIGS. 4, 14A and 14B show top plan views of coverings 400 and 1400, respectively. Covering 400 includes a plurality of fins 410 having reinforcing members 465. Covering 1400 has a plurality of fins 1410 with reinforcing members 1465.

Figure 5:
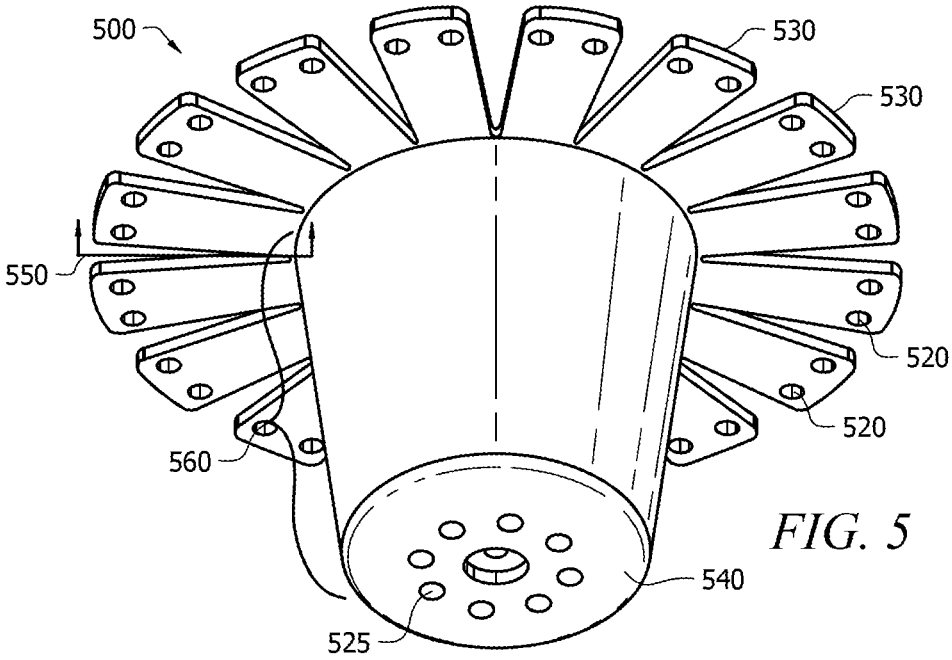
FIG. 5 depicts a representative bottom plan view of the embodiment of FIG. 2.
Figure 15:
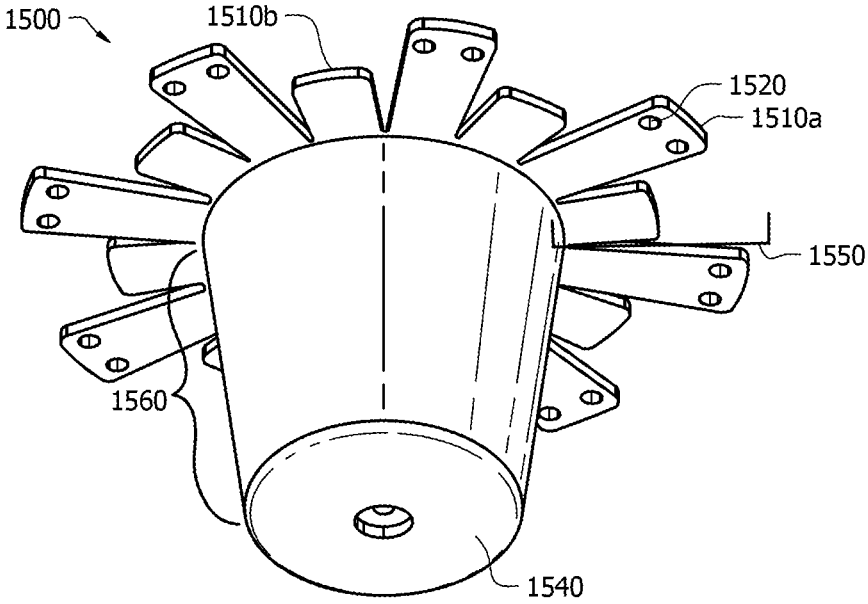
FIG. 15 depicts a representative bottom plan view of the embodiment of FIG. 1.

FIGS. 5 and 15 show bottom plan views of covering 500 and 1500, respectively. Covering 500 includes a plurality of radially extending fins 510 and boss 520 and 525. Covering 1500 comprises a plurality of radially extending fins 1510 and boss 1520.

The bore whole diameter typically ranges from 2½ to 4¾ inches. Coverings described herein may be shaped and configured in a number of dimensions. In one example, a covering has a diameter of about 8 inches and a length of about 3.75 inches. In another example, a covering has a diameter of about 4 inches and a length of about 3.5 inches. In one or more embodiments, the overall diameter of the covering may change while the length of the covering does not vary much.

Figure 7A:
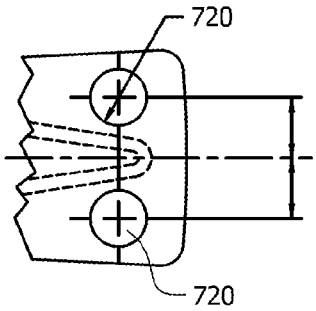
FIG. 7 depicts a boxed portion 2 of a representative fin of FIG. 3 as viewed from the bottom (FIG. 7A) and end (FIG. 7B)
Figure 7B:
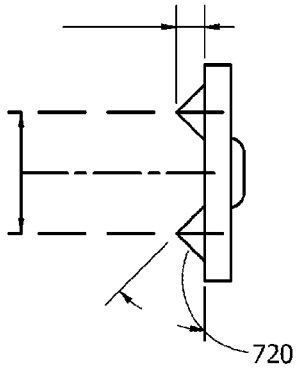

When formed, coverings generally include a perimeter region and a conical region. Referring again to FIGS. 4, 5, 14A and 15, the perimeter region is represented by a region bounded by line 450 of FIG. 4 or line 550 of FIG. 5 or line 1450 of FIG. 14A or line 1550 of FIG. 15. The conical region is represented by a region bounded by line 460 of FIG. 4 or line 560 of FIG. 5 or line 1460 of FIG. 14A or line 1560 of FIG. 15. The conical region is open on its upper ends as illustrated in FIGS. 4 and 14B. Further openings may be placed on the lower end of the conical region, such as at surface 540 of FIG. 5 or surface 1540 of FIG. 15. Both the perimeter region and the conical region may further comprise one or a number of boss. On the perimeter, boss are typically positioned on one planar surface of a fin. FIG. 7A illustrates one suitable location for boss 720, positioned as a pair near an end of the fin and on one planar surface. FIG. 15 illustrates an additional and suitable location for boss 1520, positioned as a pair on an end of fin 1510*a* and on only one planar surface. Boss may be shaped as depicted in FIG. 7B. In addition or as an alternative, boss may include other shapes, such as having less or more taper, having more than one taper, having a hook or other shaped end, or made in another shape, such as a cylinder, sphere, or rectangle, as examples. On the conical region of a covering described herein, boss may be located on an exterior and bottom surface, such as depicted as boss 525 on surface 540 of FIG. 5. Boss may offer assistance when positioning the coverings when stacking. Boss may also offer assistance for engagement of the covering with a hole, as further described elsewhere.

Figure 16:
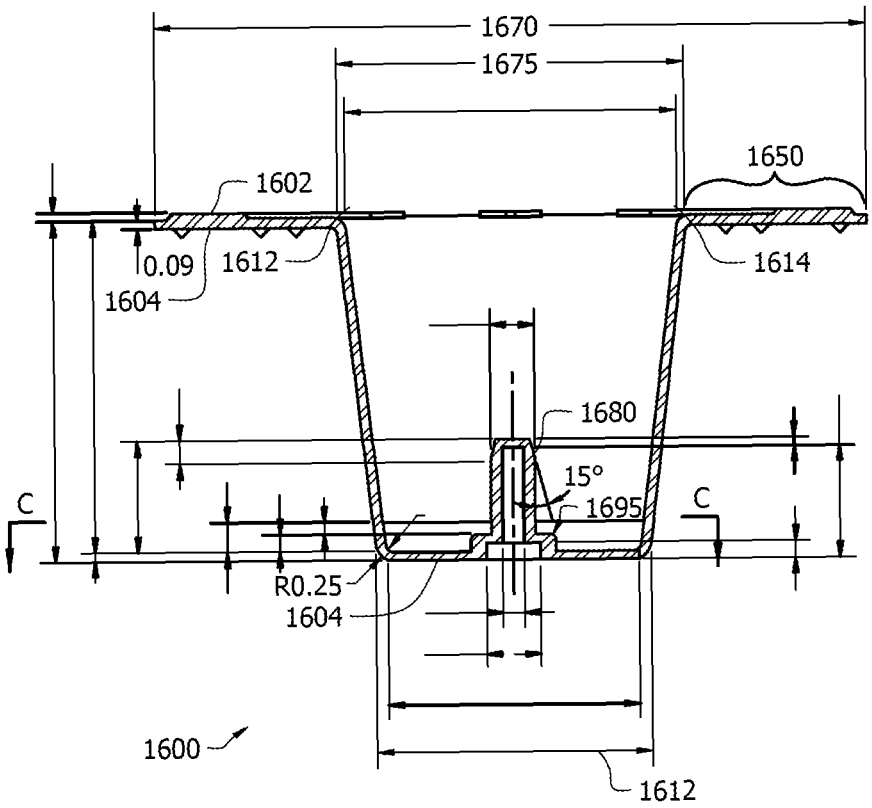
FIG. 16 depicts a representative cross sectional view of FIG. 1 taken at line A.

Referring now to FIGS. 6 and 16, representative coverings 600 and 1600 are illustrated. FIG. 6 is a cross sectional view taken at line B of FIG. 2. FIG. 16 is a cross sectional view taken at line A of FIG. 1. Covering 600 has a first surface 602 and a second surface 604. The region bounded by surfaces 602 and 604 represents a wall thickness of the covering, which is generally less than 1 inch and may be less than half an inch, and may be less than one quarter of an inch, and may be less than one-eighth of an inch. Similarly, covering 1600 has a first surface 1602 and a second surface 1604. The region bounded by surface 1602 and 1604 represents a wall thickness of the covering.

The conical regions of covering 1600 is depicted as a region bounded by line 1612 to line 1614. In some embodiments, the conical region may be hollow. In additional embodiments, the conical region may include one or more additional elements. Often, in the conical portion is hub 680, as depicted in FIG. 6, or hub 1680, as depicted in FIG. 16. Hub 680 extends from inner surface 602 (FIG. 6). Hub 1680 extends from inner surface 1602 (FIG. 16). The hub may serve one or more purposes, such as acting as a supporting member or for positioning one or more additional elements that cooperate with coverings described herein when in use. The hub may enhance installation of the covering and/or stabilize the covering.

Figure 11:
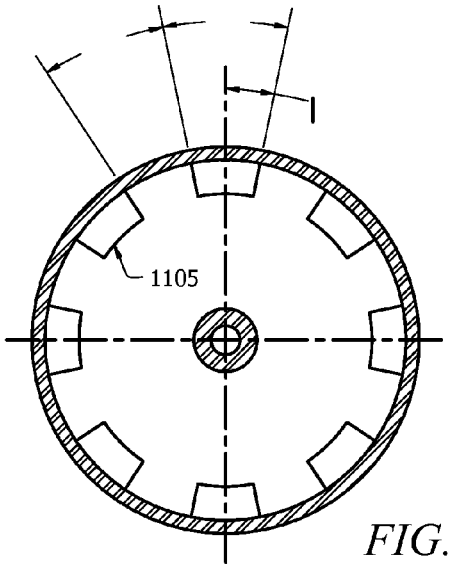
FIG. 11 depicts a representative top view of inner conical portion of FIG. 1.

A view from the top of one or more embodiments described herein may reveal a means for retaining in the form of one or more tabs 105 and 1105, as illustrated in FIGS. 1 and 11, respectively. Tabs, when included, may be molded together with the conical portion or snap-fit later into position. Tabs extend out into the interior of the conical portion and assist in fixedly positioning an additional element into the base portion and interior of the conical region. Tabs may be uniformly spaced at a desired distance apart. As an alternative, tabs may be non-uniformly spaced, which may ease fit of an element under the tabs. While eight tabs are depicted in FIGS. 1 and 11, the number and size of tabs may be modified, as desired, in order to suitably retain an additional element in the base portion of a conical region.

Figure 17:
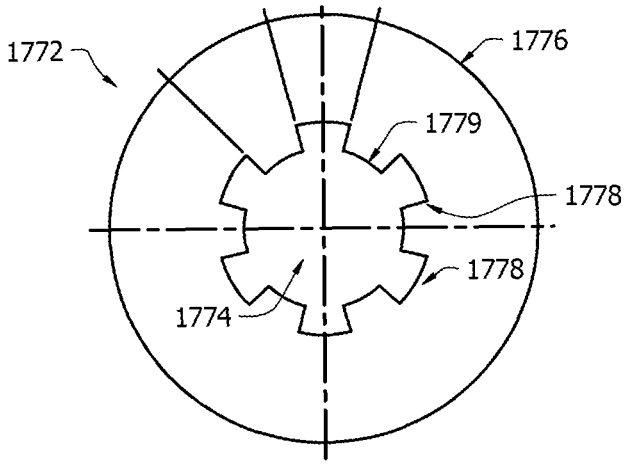
FIG. 17 depicts a front view of a representative retainer as described herein.
Figure 18:
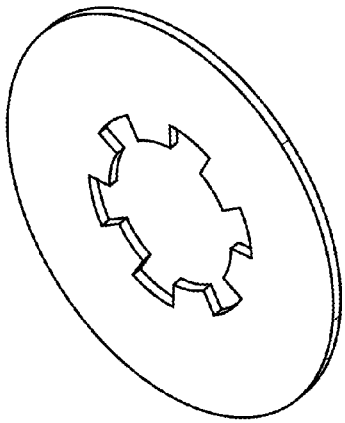
FIG. 18 depicts a perspective view of the retainer of FIG. 17.
Figure 19:
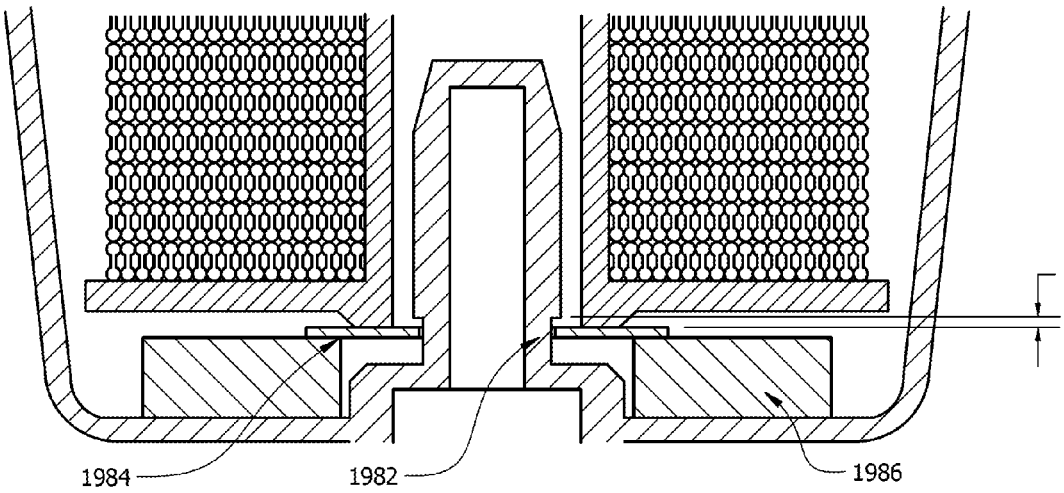
FIG. 19 depicts a further representative cross-sectional view of a covering described herein.

In addition or as an alternative, a means for retaining may include a retainer, such as a representative retainer shown in FIGS. 17 and 18. Such a retainer, depicted as 1772 in FIGS. 17 and 18, generally includes a hollowed center portion 1774 and an outer portion 1776 that may or may not be solid. The outer portion may include additional features, such as ribbing, for changing its weight as well as one or more spaces or holes to save on cost of fabrication. The retainer is often made of a flexible material, such as a plastic polymer that offers movement to the plastic when formed. The retainer may or may not fit snugly in the conical portion. In one or more forms, the retainer has ring-like shape and is positioned over the top of a sensing element, which is described further below. The retainer may fit directly on top of the sensing element or may be above the sensing element with another element positioned between the sensing element and the retainer. In one or more embodiments, the retainer fits snugly in the conical portion around the hub and holds the sensing element in place. To assist in a snug fit, a retainer described herein may include one or more recessed portions 1778 and one or more non recessed portions 1779. The non-recessed portions 1779, due to the flexibility of the retainer material, may bend when there is a snug fit between the edges of the hollowed center portion of the retainer and a central hub of the covering. In some embodiments, a hub is indented at its lower end allowing a retainer to be maintained in position near the base of the conical portion of the covering. An example of a hub having an indented portion is shown at 1982 in FIG. 19. An example of a retainer in FIG. 19 is 1984. An example of a sensing element in FIG. 19 is 1986. In one or more embodiments a retainer, such as that shown in FIGS. 17 and 18 is about less than about 0.05 inches thick or is about 0.03 inches thick.

In one example and referring again to FIG. 6, the diameter of a perimeter portion, depicted by line 670, is about 8 inches and the diameter of a bottom surface, depicted by line 665, is about 3 inches. The thickness of the covering between surfaces 602 and 604 is at or less than about one-eighth of an inch or about 0.12 inches (excluding any thickness added by a reinforcing member and/or boss). The reinforcing perimeter portion as shown by region 650 is about 2 inches in length. Hub 680 of FIG. 6 is approximately or greater than about 3 and three quarter inches long. The diameter defined by line 675 is about 3 and a quarter inches. Boss 625 has a height of greater than one-eighth of an inch or about 0.13.

In another example and referring to FIG. 16, the diameter of a perimeter portion, depicted by line 1670, is about 8 inches and the diameter of a bottom surface, depicted by line 1612, is about 3 inches. The thickness of the covering between surfaces 1602 and 1604 is at or less than about one-eighth of an inch or about 0.09 inches (excluding any thickness added by a reinforcing member and/or boss). The perimeter portion shown as region 1650 is about 2 inches in length. Hub 1680 of FIG. 6 is about 1 and a quarter inches long. The length defined by line 1675 is at or greater than about 3 and three quarter inches.

Figure 12:
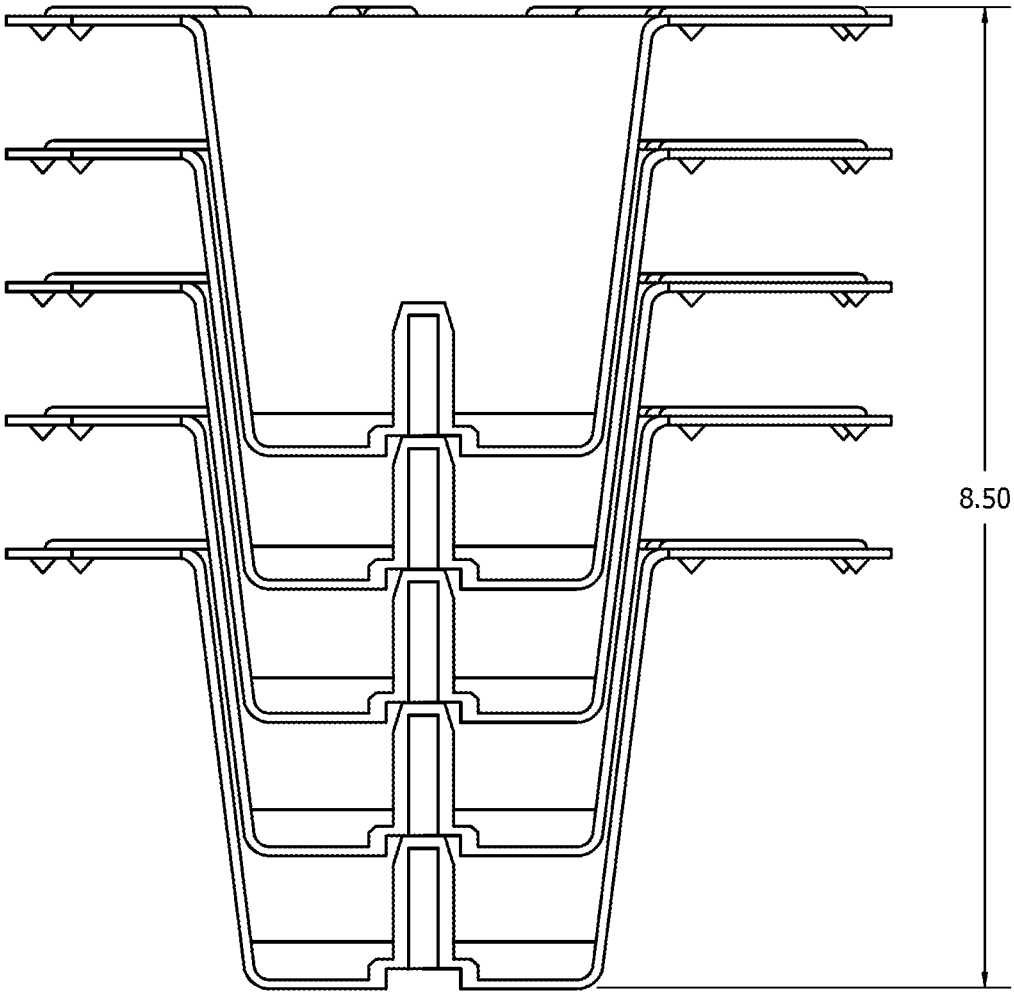
FIG. 12 depicts a representative cross sectional view of several coverings when positioned loosely together.

An example of stacked coverings is shown in FIG. 12.

In one or more embodiments a covering is cooperative with one or more of the following that includes an electrically operating means, a detonating means, a sensing means. Such additional elements aid at least in application of the covering and/or in re-locating the covering after placement.

In one or more embodiments a covering includes a sensing element. The sensing element may be sized and fitted to the covering. In some embodiments, snaps positioned in the interior and base portion of the conical region may be included to assist in a more fixed placement of the sensing element. The sensing element generally fits around a hub, in coverings that include one. An example of a sensing element is shown as element 1485 in FIG. 14A. Here, a sensing element is donut or ring-shaped, capable of sitting at the bottom of the conical portion of the covering and is fitted by snaps 1405. Element 1485 may rest on or around shoulder 1495, which is also depicted as shoulder 1695 in FIG. 16. In addition or as an alternative, sensing element may rest on or around a shoulder and be maintained by a retainer, such as shown in FIG. 19. In such a depiction, the conical portion may not require snaps. The sensing element may be sized and shaped to fit snug or loosely within the conical portion. The sensing element may be an element that induces a magnetic field, such as a permanent magnet, ferromagnet, electromagnet. The sensor may also include, be cooperative with, or in the alternative be a sensor for pressure, temperature, vibration, acceleration, chemicals, fluid, piezoelectric properties and the like. The sensing element may act in cooperation or replace a means for sensing, which is described in more detail below.

Figure 10:
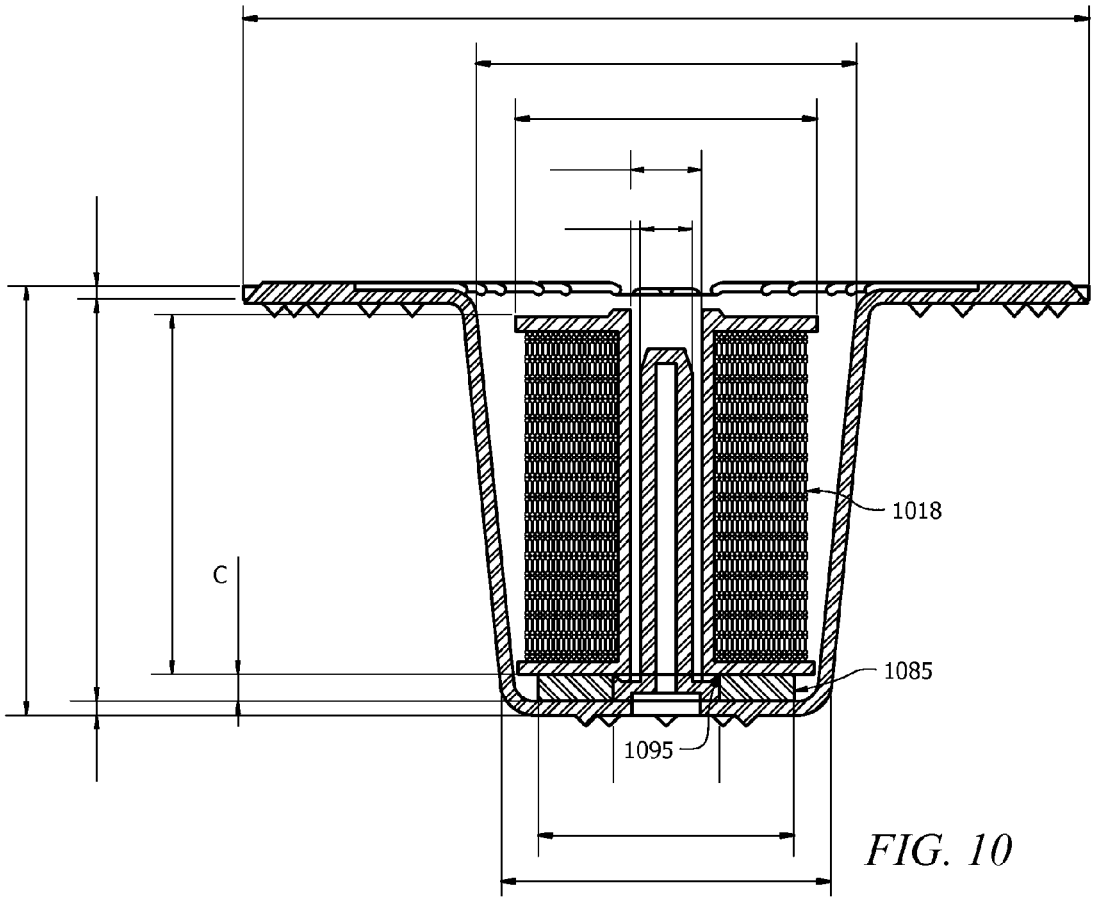
FIG. 10 depicts another representative cross sectional view of FIG. 2 taken at line B.

In one or more embodiments, coverings described herein include an electrically operating means at least for connecting to and/or operating as a source of electrical power. The electrical power may cooperate with the sensor or other cooperative elements. The electrical power may include a blasting machine or battery or other power source. Another example of an electrically operating means is a spool. A representative spool 1018 is illustrated in FIG. 10. In FIG. 10, spool 1018 is shown to rest on shoulder 1095 and above element 1085. A spool, such as that depicted in the drawing, is typically comprised of industry insulated standard wire (12 gauge or 16 gauge to 22 gauge), the lead wire conforming with ASTM B-33 or other suitable standard. The electrically operating means may also cooperate with a detonating means, which may include a container or capsule containing one or more explosive materials. One example of a detonating means is a blasting cap (not shown). Blasting caps may be electric or non-electric. Cooperation between an electrically operating means and a detonating means may enhance safety and/or reduce further operational steps. The detonating means may be remotely actuable, relying on radio waves or alternative sources. The detonating means may be wired to a remote actuation site that is separate or in cooperation with the electrically operating means. In one or more embodiments, wiring is wrapped around a spool and retained in the thru hole.

In one or more embodiments, coverings described herein include a means for sensing that operates at least for locating the covering. The means for sensing includes one or more sensing materials and/or electrical components useful for locating the covering after placement. The sensing material may include a magnetic and/or piezoelectric material, as examples. The sensing means may further include electrical components, such as a coil or spool to detect changes, such as magnetic fields. The sensing means may cooperate with a telemetry element that provides signals to another source (e.g., receiving station or control center); signal may be generated by or recovered by the means for sensing. Transmissions to the receiving station may be via radio frequency or via a transmission line (e.g., conductor line, fiber optic line, as examples).

Coverings described herein are generally made of a material that is considered flexible. Examples include plastic. A low density plastic may be used, such as a low density polyethylene. The material used is generally not water permeable.

A covering described herein is generally molded as single piece. Molding methods used are those known to one of ordinary skill in the art.

The permeability of the covering may be improved by including small incisions or shaped cuts along or near the base of the conical portion that allow flow of fluids through the covering to reduce movement after placement.

For placement, a hole is made from a surface and extends through a mass. The mass may be solid or semi-solid and may be of a finite or an infinite thickness. In some embodiments, the hole is drilled. The dimension of the covering described herein, as viewed in a top plan view (e.g., FIGS. 1 and 2), will generally vary as accorded by the diameter of the hole. Thus, the shape and size of a covering described herein is generally directed by the dimensions of the hole to be covered and/or filled. The hole diameter must be smaller than the diameter of radially extending fins of the covering, an example of such a diameter is depicted as line 670 of FIG. 6. In some embodiments, the largest diameter of the covering may be 5-25% larger than the entry diameter of the hole. In some embodiments, the largest diameter of the covering may be more than 25% larger than the entry diameter of the hole. The hole must at least be larger than the cross sectional diameter of the conical portion, such as that shown as line 675 of FIG. 6.

A covering having outwardly extending fins is placed with the conical portion positioned in the hole first. Often, before placement, a sensing element, such as a magnet, is positioned at the base portion of the conical region under a means for retaining. Often, after the sensing element is positioned, a spool is positioned around the hub and above the sensing element. Generally, after the spool is positioned, a free end of the wire wrapped around the spool is connected to a detonating means. Another free end of the wiring may be connected electrically operable means, operable with a means for firing the detonating means remotely. The detonating means is positioned below the covering. The covering is positioned in the hole such that the base surface (such as base surface 540 of FIG. 5) is inserted first. Thus, the base of the conical portion of a covering described herein is positioned within the hole. The covering may be further lowered into the hole until it reaches a desired depth, for example 32 inches deep. The depth may vary as desired. In some embodiments the depth may vary from between about 6 inches to about 48 inches. In some embodiments, the depth may be more than 48 inches. Upon placement within the hole, the outwardly extending fins become upwardly extending fins as all or a portion of the fins abut the sides of the hole. The covering when in place may adopt the general form of a bowl shape or cup shape. The covering may be pushed down to the extent permitted or as desired. Often, the weight of the covering will not be enough to overcome friction or other forces between the fins and side walls of the hole. In this instance, the covering will remain in the position it was placed in. The covering when placed may be rotated at its desired position to further secure it in position.

The covering when positioned in the hole may form a relatively water-tight seal in the hole or may offer passage of materials from above the covering to below the covering, such as when fins are not uniformly shaped or when small incisions (described above) are made on one or more portions of the covering. The covering may cooperate with an added filler, water absorbent material or sealant positioned on and/or around the covering or along the lining of the hole to further secure the covering. An example of a securing means is clay or bentonite. Another example is an oil. A further example is an elastomeric sealer.

Although the foregoing description of embodiments have shown, described and pointed out certain novel features of the invention, it will be understood that various omissions, substitutions, and changes in the form of the detail as illustrated as well as the uses thereof, may be made by those skilled in the art, without departing from the scope of the invention. Particularly, it will be appreciated that the one or more embodiments may manifest itself in other shapes and configurations as appropriate for the end use of the article made thereby.

What is claimed is:

1. A covering comprising:

a perimeter portion, wherein the perimeter portion comprises a plurality of radially extending members having at least two planar surfaces;

a conical portion configure to plug or cover a bore hole comprising:

a central hub at a base of the conical portion; and a plurality of retaining members offset from the base of the conical portion, the retaining members having at least two planar surfaces positioned in the conical portion; and a sensing element fixedly positioned in the conical portion wherein the sensing element is a magnet.

2. The covering of claim 1, wherein one or more radially extending members have a reinforcing member on a first planar surface and wherein one or more retaining members have a reinforcing member on a first planar surface.

3. The covering of claim 1, wherein the radially extending members are unevenly sized and shaped.

4. The covering of claim 1, further comprising at least one boss on a second planar surface of one or more radially extending members.

5. The covering of claim 1, further comprising a spool in cooperation with and surrounding the hub, positioned in the conical portion of the covering and cooperative with a detonating means.

6. The covering of claim 1, wherein the spool includes electrical wiring that is cooperative with a detonating means.

7. The covering of claim 1, further comprising and cooperative with an electrically operating means.

8. The covering of claim 1, further comprising and cooperative with a sensing means.

9. The covering of claim 1, wherein the sensing element is fixedly positioned in the conical portion by the plurality of retaining members.

10. The covering of claim 1, wherein the reinforcing member is on every other radially extending member.

11. The covering of claim 1, wherein there are eight radially extending members.

12. The covering of claim 1, wherein the hub is not more than 2 inches in length.

13. The covering of claim 1, wherein at least one radially extending member includes a thru hole.

14. The covering of claim 1, further comprising a retaining ring member sized and shaped to be disposed within the conical portion, wherein the retaining ring member is retained by the indented portion of the central hub;

wherein the central hub has an indented portion offset from the base; and wherein the sensing element is held between the base of the conical portion and the retaining ring member.

15. The covering of claim 14, wherein one or more radially extending members have a reinforcing member on a first planar surface and wherein one or more retaining members have a reinforcing member on a first planar surface.

16. The covering of claim 14, wherein the radially extending members are unevenly sized and shaped.

17. The covering of claim 14, further comprising at least one boss on a second planar surface of one or more radially extending members.

* * * * *